United States Patent [19]

Bailey et al.

[11] Patent Number: 4,765,404

[45] Date of Patent: Aug. 23, 1988

[54] WHIPSTOCK PACKER ASSEMBLY

[75] Inventors: Thomas F. Bailey; John E. Campbell, both of Houston, Tex.

[73] Assignee: Drilex Systems, Inc., Houston, Tex.

[21] Appl. No.: 37,517

[22] Filed: Apr. 13, 1987

[51] Int. Cl.[4] ..... E21B 33/128; E21B 33/129

[52] U.S. Cl. ..... 166/117.6; 166/134

[58] Field of Search ..... 166/117.6, 120, 132, 166/134, 191

[56] References Cited

U.S. PATENT DOCUMENTS

| | | | |
|---|---|---|---|
| 2,713,907 | 7/1955 | Kline et al. | 166/201 |
| 3,215,205 | 11/1965 | Sizer | 166/120 X |
| 3,303,885 | 2/1967 | Kisling, III | 166/134 X |
| 3,370,651 | 2/1968 | Brown | 166/134 X |
| 3,374,840 | 3/1968 | Current | 166/134 X |
| 3,412,803 | 11/1968 | Stachowiak | 166/134 X |
| 3,554,280 | 1/1971 | Kline et al. | 166/134 |
| 3,658,127 | 4/1972 | Cochran et al. | 166/134 X |
| 3,666,010 | 5/1972 | Harris | 166/134 |
| 3,701,382 | 10/1972 | Williams | 166/183 |
| 4,397,355 | 8/1983 | McLamore | 166/297 |
| 4,611,658 | 9/1986 | Salerni et al. | 166/134 |

*Primary Examiner*—Stephen J. Novosad
*Assistant Examiner*—William P. Neuder
*Attorney, Agent, or Firm*—Edgar A. Zarins; Malcolm L. Sutherland; Steven L. Permut

[57] ABSTRACT

A packing assembly for a whipstock in which the whipstock can be run into a well casing to a level above the bottom and milling through the casing wall without having to make a round trip with the well string. The packing assembly includes slip-type anchors which initially set the assembly and packing elements which sealingly engage the well casing to seal off the casing while anchoring the device. Disposed between the packing elements is a spacer ring which is axially movable in response to the fluid pressure within the well casing to enhance the sealing engagement of the packing elements. The spacer ring includes an O-ring seal which provides improved sealing between the spacer ring and the inner mandrel to which it is mounted. In order to compress the packing elements while preventing extrusion thereof, an overleaf ring and retainer arrangement is provided thereby enhancing sealing engagement of the packing assembly.

21 Claims, 6 Drawing Sheets

12
34
44
53
46
50
54
52
32
58
56
60
62
40
40
64
38
30
66

12
30
42
68
70
40
39
30
36
12

WHIPSTOCK PACKER ASSEMBLY

BACKGROUND OF THE INVENTION

I. Field of the Invention

This invention relates to a one-trip packstock assembly and, in particular, to a whipstock packer assembly having a smaller than usual outer diameter yet capable of effectively packing-off conventional casing diameters.

II. Description of the Prior Art

Well packers are widely utilized to seal or isolate one or more zones in a well hole. Generally, several levels of interest are sealed from each other by a packing arrangement between the well casing and the work string. Packers have also been utilized to orient and support additional tools, such as a whipstock, in order to control the direction of the tool. However, most of the past known packing tools are generally designed to pack-off and seal gaps of 3/16" or smaller. Thus, the initial diameter of the packing device must closely conform to the inner dimensions of the well casing.

Because of the small leeway provided in conventional packing tools, such devices have a tendency to hang-up in the casing as they are lowered therein. This is particularly problematic in casing packers which are run in conjunction with additional tools thereby extending the overall length of the combination tool. As the length of the tool associated with the packer is increased, the ability to maneuver through irregular casing sections is decreased due to the limited leeway between the packer and the casing wall. In order to reduce hang-ups, such multiple tool operations are generally conducted in two trips. The first trip is utilized to run and set the packing device while the second trip positions the working tool, such as a whipstock utilized to sidetrack a well. Since the packing tool was only a few feet long it could easily be maneuvered through the casing. However, the two trip operations resulted in increased costs particularly in very deep well operations. Moreover, while running the whipstock and packer individually is normally a fairly simple procedure, a highly deviated well may require that the packer be run on the drillstring. In this situation, a simple procedure becomes time-consuming and complex.

In order to reduce production costs, a one-trip tool adapted to pack-off gaps of greater than one-half inch was developed. Such a combination tool is described in U.S. Pat. No. 4,397,355 entitled Whipstock Setting Method and Apparatus. The packing tool described therein is adapted to pack-off the increased gap. However, it has been found that because of the larger gap the rubber sealing element has a greater tendency to extrude along both the inner mandrel and the casing wall, thereby causing leakage past the packing element. Pressure packers have also been utilized in an attempt to prevent this leakage. However, these pressure packers would only withstand pressures proportional to the pressure initially put into packers since the pressure supply line is severed upon actuation of the whipstock. Any increase in downhole pressure would cause leakage past the tool.

Thus, the past known tool have failed to effectively seal and pack-off the casing, particularly when extreme well pressures are present.

SUMMARY OF THE PRESENT INVENTION

The present invention overcomes the disadvantages of the prior known whipstock packers by providing a packing assembly which has a smaller diameter to facilitate running of the tool.

The unique packing structure of the present invention includes a pair of packing elements with a slidably movable spacer disposed intermediate the packing elements. The configuration of the packing elements and spacer cooperate to form a fluid seal at both the inner diameter and the outer diameter of the packing elements. The metal spacer ring acts as a pressure energized seal and includes an O-ring seal at its inner diameter to enhance the sealing capabilities of the spacer. Disposed at the outer ends of the packing elements are overlayed expansion fingers which limit extrusion of the packing elements upon compression. Finally, outer rubber retainers and metal expansion rings are utilized to retain the packing element while providing additional sealing and packing strength. Each of these elements are slidably mounted to an inner mandrel so that compression of the assembly can be carried out.

The packing assembly of the present invention is utilized in conjunction with an improved one-trip whipstock apparatus. Once the whipstock and packer are lowered into the well hole, the packing assembly is set utilizing hydraulic pressure supplied through a supply line extending through the whipstock to the packer. Thereafter, the mill of the whipstock is disconnected and lowered to commence the milling process directed by the whipstock. Alternatively, the whipstock and packing assembly may be independently lowered into the well hole using a setting tool or other type of running device prior to running the mill or drill bit into the hole.

Thus, the present invention provides an improved whipstock apparatus which can be run with a packer connected to its lower end to set the tool at the desired level and orientation in a single run of the well string. The packing assembly is adapted to withstand extreme well pressures and severe pressure differentials.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views, and in which.

DETAILED DESCRIPTION OF A PREFERRED EMBODIMENT OF THE PRESENT INVENTION

Figure 1:
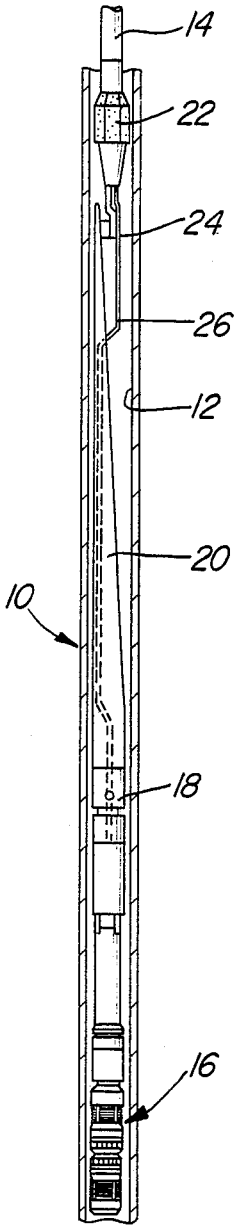
FIG. 1 is a cross-sectional perspective of a well bore with the apparatus of the present invention oriented therein.
Figure 2:
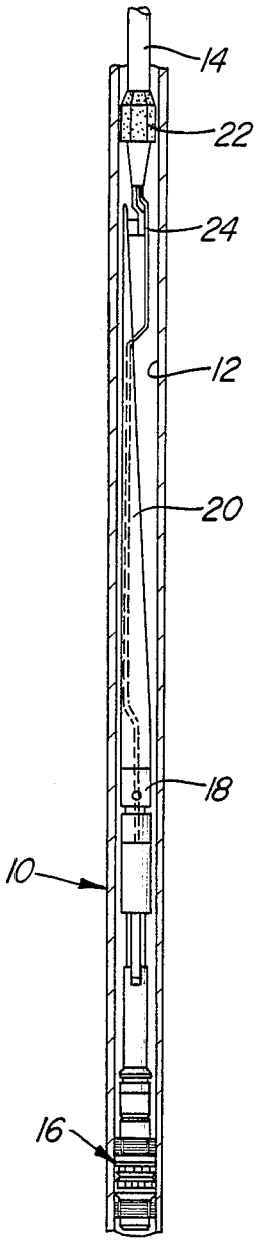
FIG. 2 is a cross-sectional perspective of a well bore with the apparatus oriented therein and the packing assembly set.
Figure 3:
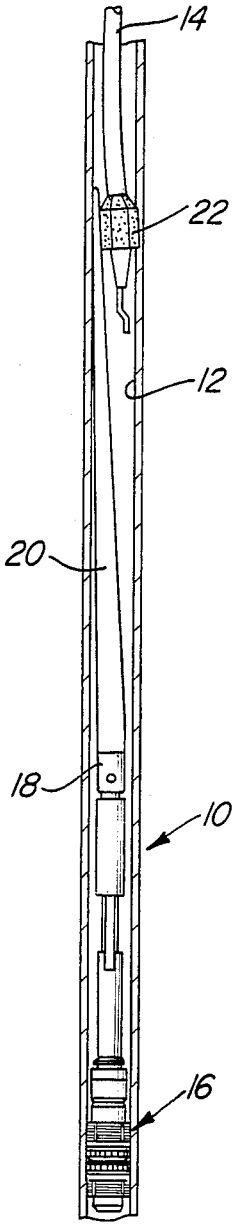
FIG. 3 is a cross-sectional perspective of a well bore with the apparatus oriented therein and the mill separated from its attachment to the whipstock apparatus.

Referring first to FIGS. 1 through 3, the whipstock assembly is thereshown oriented within the well bore or casing 12 by drill string 14. The whipstock assembly 10 generally includes a packing assembly 16 which is connected by sub 18 to the lower end of whipstock 20. A mill 22 is releasably connected to the whipstock 20 by shear pin 24 so that the entire assembly 10 can be run into the casing at one time. The whipstock assembly 10 is lowered into the well bore 12 by way of drill string 14 until the desired orientation is achieved in the area of the directional cut through the bore wall as will be subsequently described. Depending upon the desired operation, the whipstock 20 and the packing assembly 16 can first be run into the hole using a setting tool or other type of running device or, alternatively, the whipstock assembly 10 can be run in conjunction with the detachable mill 22 in order to further reduce the number of operations.

Figure 4:
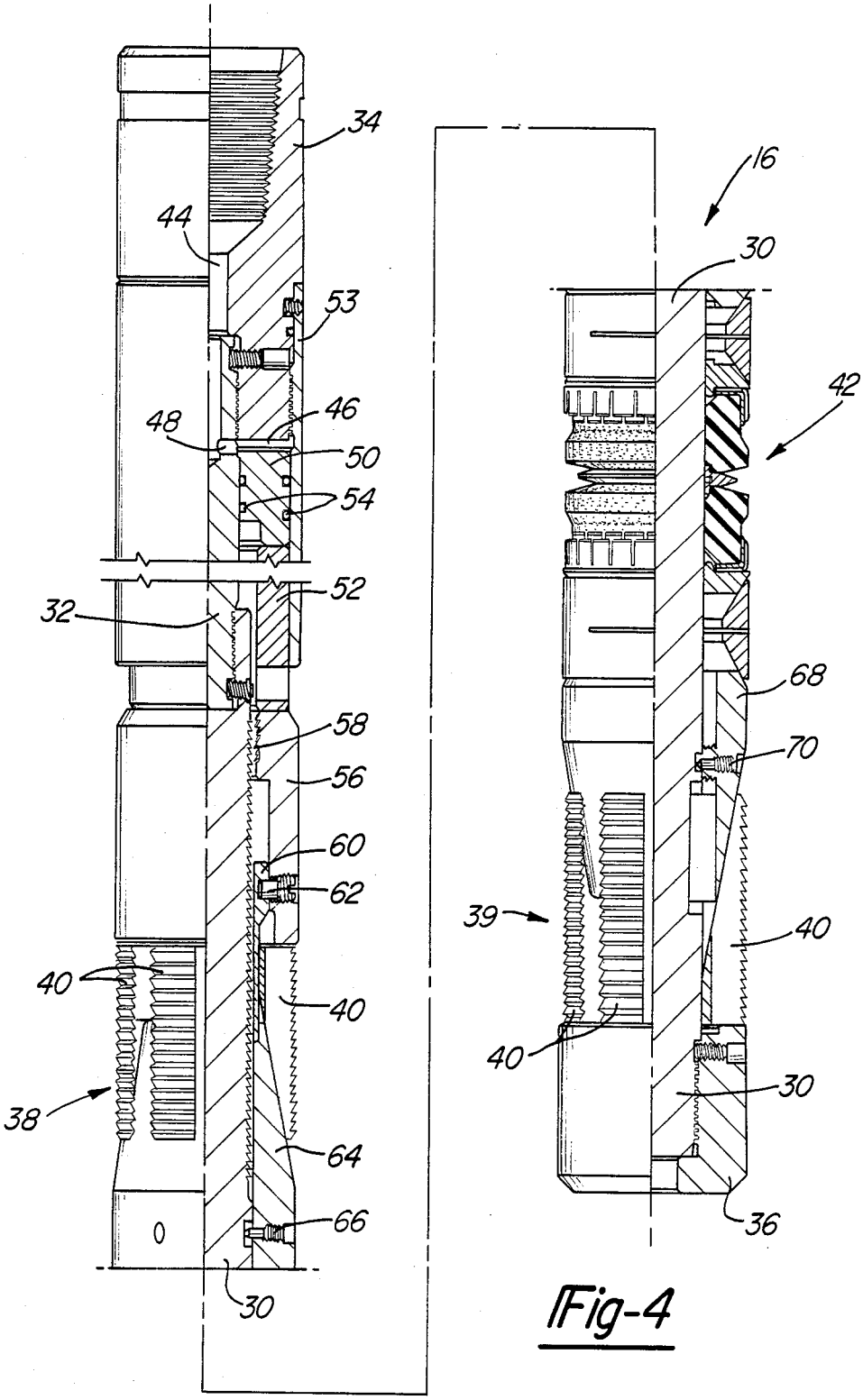
FIG. 4 is a partial sectional perspective of the packer assembly of the present invention in the unset or running position.

Referring now to FIG. 4, the packing assembly 16 includes an inner mandrel 30, a piston rod 32 threadably connected to the upper end of the mandrel 30, and an adapter sub 34 threadably connected to the upper end of the piston rod 32. The packing assembly 16 also includes an upper, slip-type anchoring means 38 mounted to the mandrel 30 above packing means 42 and a lower, slip-type anchoring means 39 mounted to the mandrel 30 below packing means 42. Both anchoring means 38 and 39 include a plurality of expandable slips 40 which move outwardly to engage the well casing thereby setting the tool as will be described.

Lower anchoring means 39, packing means 42 and upper anchoring means 38 are sequentially set through hydraulic pressure supplied from the work string 14 through a supply line 26 which is connected to a central passage 44 formed in the adapter sub 34. The passage 44 is connected to annulus 46 by way of one or more lateral ports 48. The annulus 46 acts as a cylinder chamber such that as hydraulic pressure within the annulus 46 increases, piston 50 and piston sleeve 52 are caused to move downwardly relative to the piston rod 32 and outer retaining sleeve 53. In order to prevent pressure loss, the piston 50 is provided with a plurality of O-ring seals 54 along the inner and outer surfaces thereof. Downward movement of the piston assembly in turn acts against a lock housing 56 mounted to the mandrel 30. The lock housing 56 cooperates with a lock nut 58 which interacts with the inner mandrel 30 to prevent release of the packing assembly 16 when pressure is released after setting of the tool. The inner radial surface of the lock housing 56 includes a plurality of serrations which cooperate with the inversely serrated outer surface of locking nut 58. Similarly, the outer radial surface of mandrel 30 includes serrations which cooperate with inverse serrations formed in the inner surface of locking nut 58. Thus, as the piston assembly causes the lock housing 56 to move downwardly, the locking nut 58 moves in conjunction therewith causing the inner serrations of the locking nut 58 to move over the serrations of the mandrel 30. The interacting edges of the serrations ensure that movement will only be in one direction thereby preventing release of the anchoring and packing means.

Referring still to FIG. 4, the lock housing 56 is connected to an inner sleeve 60 by shear screws 62. The inner sleeve 60 extends beneath the slips 40 of upper anchoring means 38 and abuts against upper cone 64. The upper cone 64 is releasably connected to the inner mandrel 30 by shear screws 66 and forms an upper abutment surface for compression of the packing means 42. Similarly, a lower cone 68, which is releasably connected to the mandrel 30 by shear screws 70, forms a lower abutment surface for the packing means 42. The lower cone 68 includes a sloped surface which interacts with slips 40 of lower anchoring means 39 to drive the slips 40 outwardly into engagement with the casing wall 12. Downward movement of the slips 40 is prevented by end cap 36.

Figure 5:
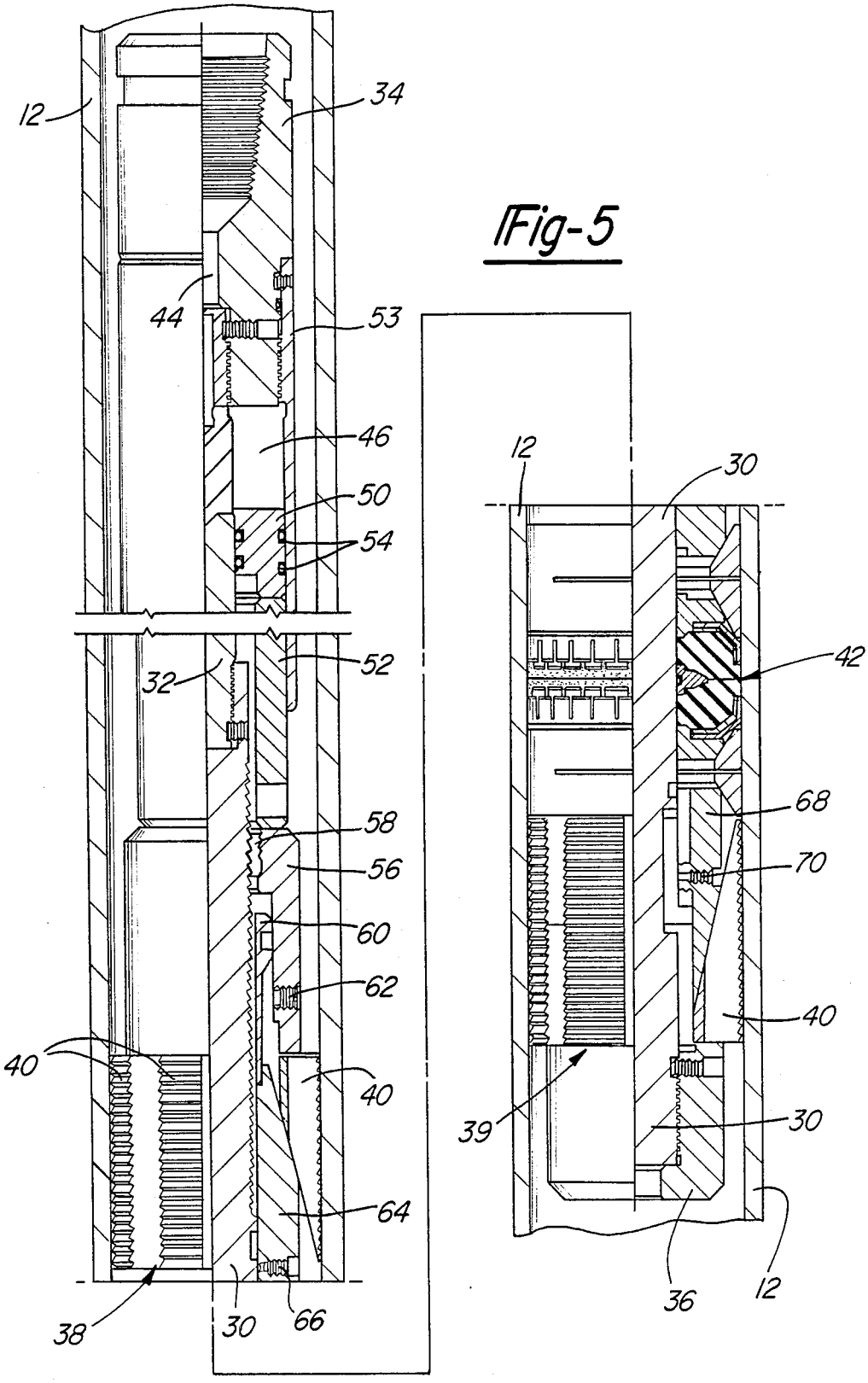
FIG. 5 is a partial sectional perspective of the packer assembly set within a well bore.

When fluid pressure is supplied to annulus 46, the piston 50, piston sleeve 52 and lock housing 56 move downwardly to set the tool. The shear screws 62, 66 and 70 are designed to have different strengths whereby shear screw 66 is the weakest, shear screw 70 the next weakest, and shear screw 62 the strongest. Thus, as pressure is applied, screw 66 will shear first in order to permit the lock housing 56 to act against the inner sleeve 60 which in turn causes the upper cone 64 to move downwardly. This downward movement of the upper cone 64 compresses the packing means 42 into sealing engagement between the mandrel 30 and the casing wall 12. Continued pressure will cause the screws 70 to shear thereby moving the lower cone 68 beneath the slips 40 of lower anchoring means 39 to engage the slips against the casing wall as shown in FIG. 5. Finally, upon full compression of the packing means 42, continued downward pressure will cause the screw 62 to shear thereby allowing the lock housing 56 to engage the slips 40 of upper engaging means 38 causing them to move downwardly and outwardly against the upper cone 64 and into engagement with the casing wall 12 as shown in FIG. 5.

Figure 6:
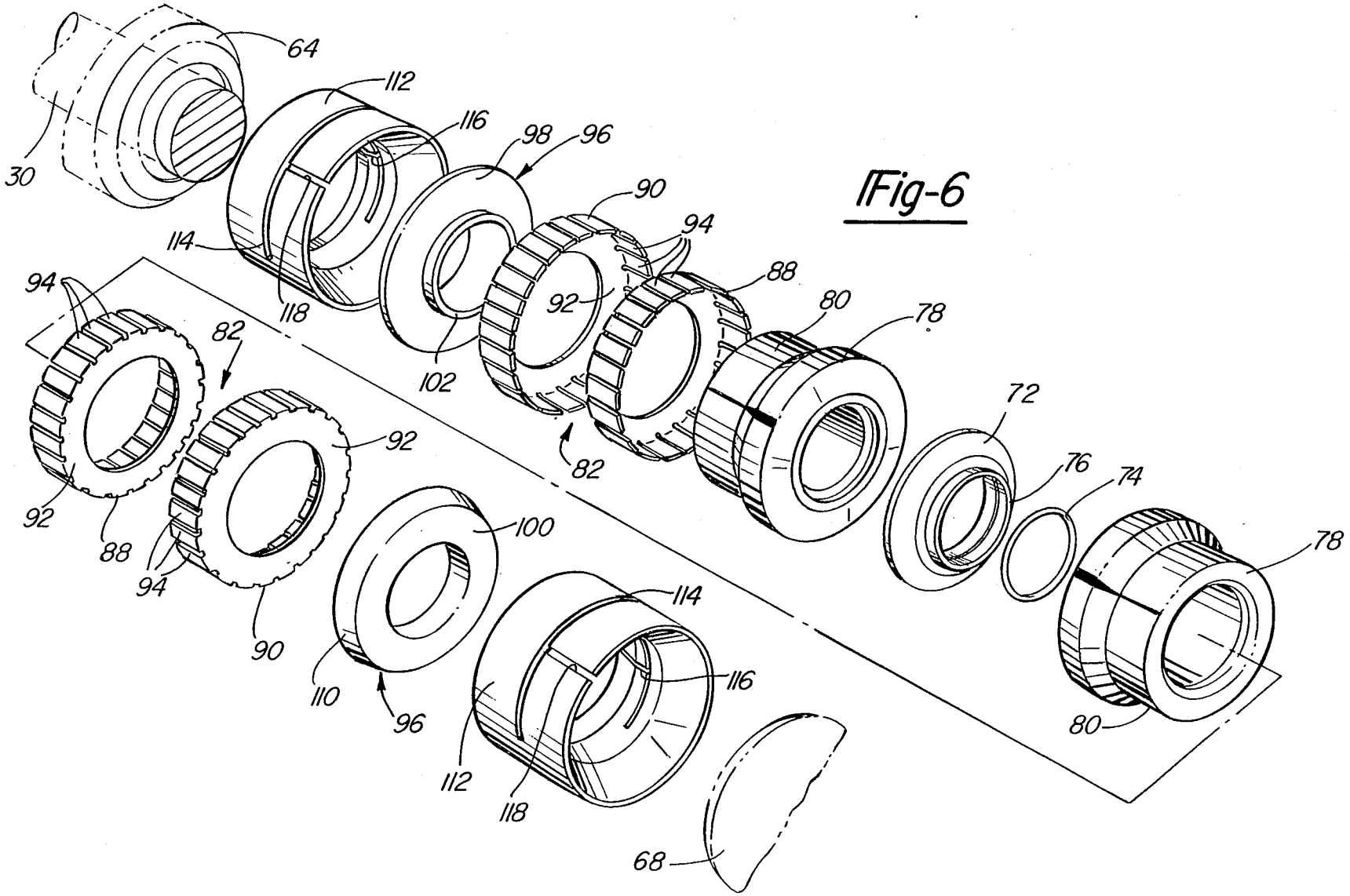
FIG. 6 is an exploded perspective of the components of the packer assembly.
Figure 7:
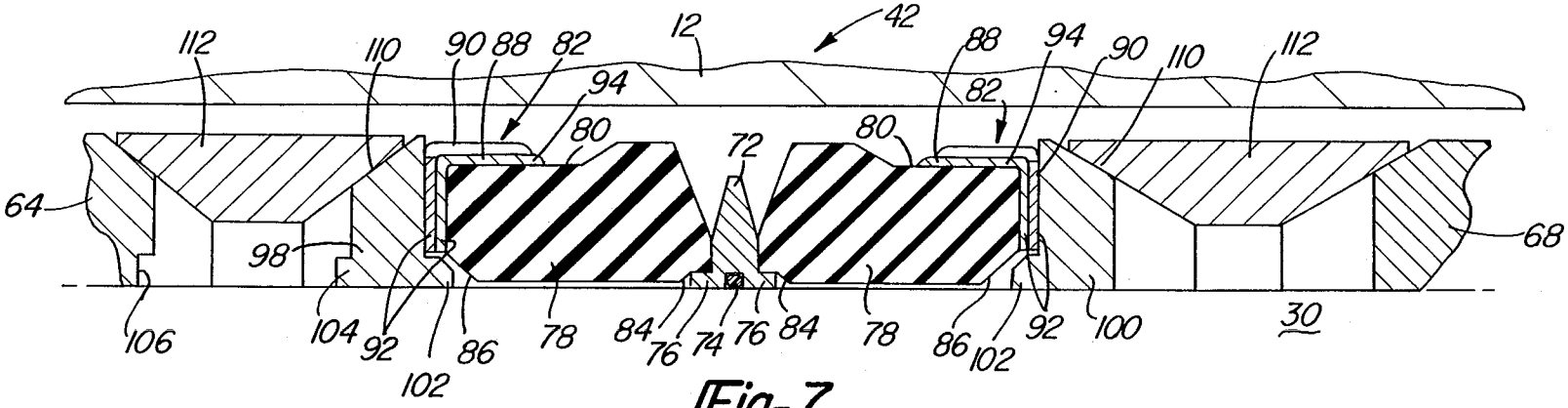
FIG. 7 is a partial cross-sectional view of the packing means of the present invention in its unset position.
Figure 8:
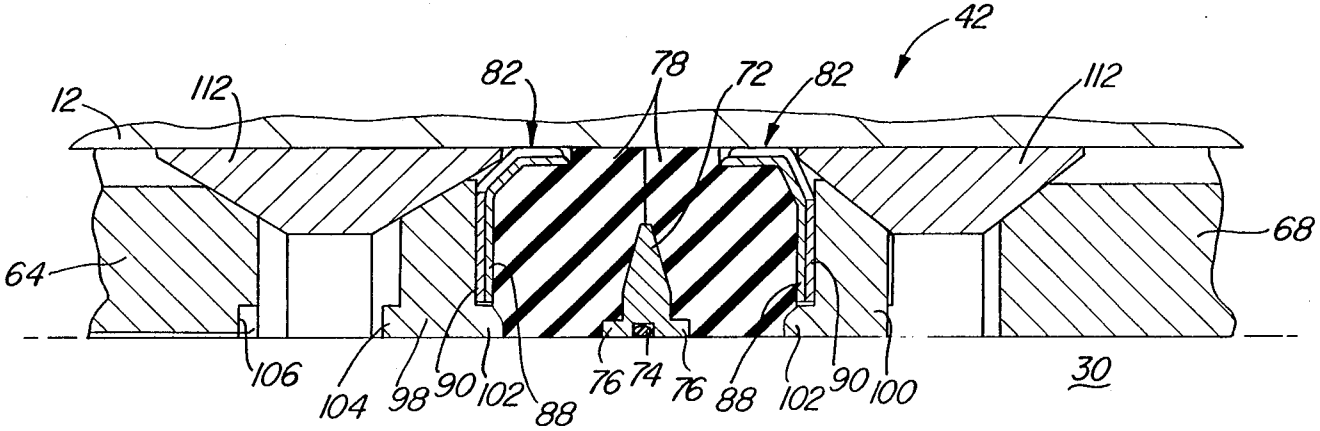
FIG. 8 is a partial cross-sectional view of the packing means in the set or compressed position.

The components of the packing means 42 have been carefully designed to cooperate so as to bridge or seal the larger gap between the inner diameter of the well casing 12 and the outer diameter of the packing assembly 16 while preventing extrusion of the packing elements which could result in leakage and blowouts. As shown in FIGS. 6 through 8, the packing means 42 is axially symmetrical about a metal spacer ring 72 which is slidably mounted to the mandrel 30. The spacer ring 72 is provided with a seal 74 mounted in an annular groove formed in the inner radial surface of the spacer ring 72. The seal 74 sealingly engages the inner mandrel 30 to prevent fluid seepage past the spacer ring 72. The spacer ring 72 has a substantially tapered cross-sectional configuration, as shown in Fig.7, and includes outwardly extending annular shoulders 76. The spacer ring 72 is slidably movable along the mandrel 30 in order to compensate for pressure variations applied to the packing means 42.

The spacer ring 72 is disposed between a pair of resiliently deformable packing elements 78. As will be subsequently described, upon compression of the packing means 42, these packing elements 78 are deformed outwardly into sealing engagement with the casing wall 12. The packing elements 78 include a radially reduced portion 80 designed to receive expansion overleaf means 82. In addition, the packing elements 78 include inner removed portions 84 and outer removed portions 86 which are designed to reduce friction during setting of the device thereby increasing the sealing engagement.

The expansion overleaf means 82 are disposed axially above and below the packing elements 78 and preferably comprises an inner overleaf shoe 88 and an outer overleaf shoe 90. The overleaf shoes 88 and 90 have similar constructions although the outer overleaf 90 has a slightly greater diameter such that inner shoe 88 can be received within the outer shoe 90 as shown in FIG. 7. The overleaf shoes include a radial flange portion 92 having an opening therethrough to receive the mandrel 30 and a plurality of radially disposed expansion fingers 94. Thus, the shoes have a substantially L-shaped cross-section with the expansion fingers 94 aligned axially and overlying the reduced portion 80 of the packing elements 78. The overleaf means 82 are slidably mounted to the mandrel 30 with the radial flange portion 92 of each shoe sandwiched between the associated packing element 78 and annular retainer means 96.

Although the retainer means 96 have a substantially similar configuration, in a preferred embodiment their configurations are slightly different in order to enhance sealing engagement. The retainer means 96 includes an upper metal retainer 98 and a lower metal retainer 100. The retainers include an inwardly extending portion 102 which cooperates with the associated packing element 78 to form a channel within which the flange portions 92 of the overleaf shoes 88 and 90 are received and retained. Moreover, both retainers have an upper sloped surface 110 which cooperates with expansion rings 112 to guide the rings into engagement with the casing well.

Referring still to FIGS. 6–8, the expansion rings 112 include an upper expansion ring means comprising first and second expansion ring and a lower expansion ring. Each of these expansion rings has a substantially triangular cross-sectional configuration with inwardly disposed sloped surfaces which cooperate with the retainers on one side and the respective cones 64 and 68 on the other side. In order to allow for expansion of the rings during compression of the packing assembly, the rings include slot 114 which extends partially about the circumference of the expansion ring 112. In addition, a pair of transverse slots 116 and 118, extending from one edge of the ring to the circumferential slot 114, are formed on opposite sides of the center slot 114 and remote from each other such that expansion can occur without leaving a gap in the expansion ring 112. Thus, as compression of the packing means 42 occurs, the transverse slots 116 and 118 of the expansion rings 112 will enlarge to permit radial expansion of the rings 112. The expansion will continue until the outer radial surface of the rings 112 engages the casing wall 12 as shown in Fig. 8. Moreover, as the rings 112 expand they come into contact with the expansion overleaf rings to further prevent extrusion of the packing elements 78.

Figure 9:
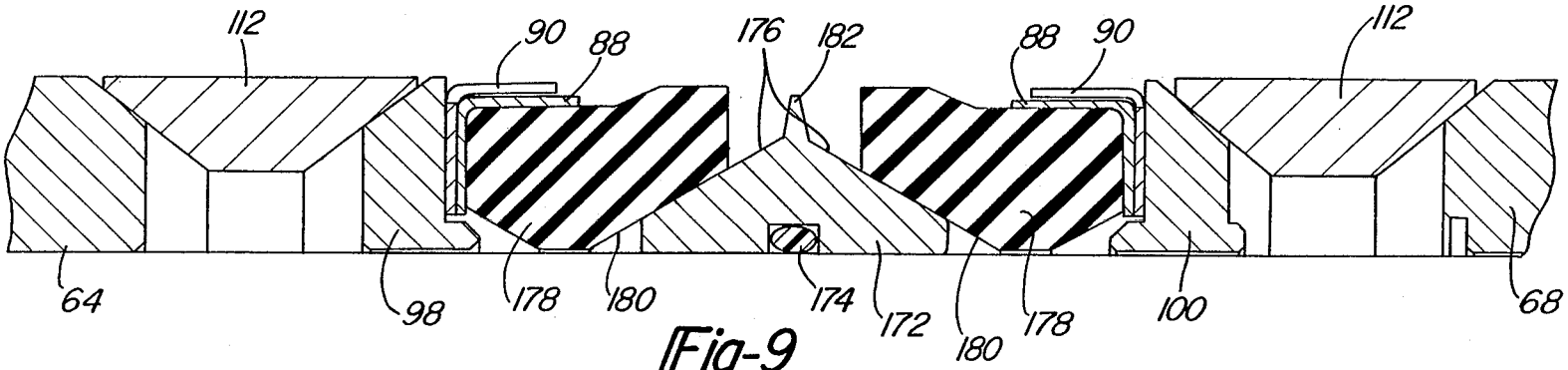
FIG. 9 is a partial cross-sectional view of the alternative embodiment of the packing means of the present invention.

FIG. 9 shows an alternate embodiment of the packing means 42 which includes a larger spacer 172 having sloping outer surfaces 176. These sloped surfaces 176 cooperate with the packing elements 178 to ensure that the casing is packed off. The spacer 172 has a substantially triangular cross-section with a wider base section than that of the previous embodiment. In order to provide efficient packing the packing elements 178 have inner sloped surfaces 180 which conform to the slope of the spacer 172. In addition, the spacer 172 includes annular flange 182 which, as with the spacer 72, drives the resilient packing elements 178 outwardly towards the casing wall prior to mutual contact. In this manner, the seal against the casing is established before the packing elements 178 set against each other. The flange 182 also ensures that the packing elements 178 meet in the center such that the packing is uniform on both sides. Moreover, by varying the slope of the surface 176, the force required to sealingly pack-off the casing can be varied although in the embodiment shown only about one-half the packing force is necessary when compared to the packing means shown in FIG. 7.

Figure 10:
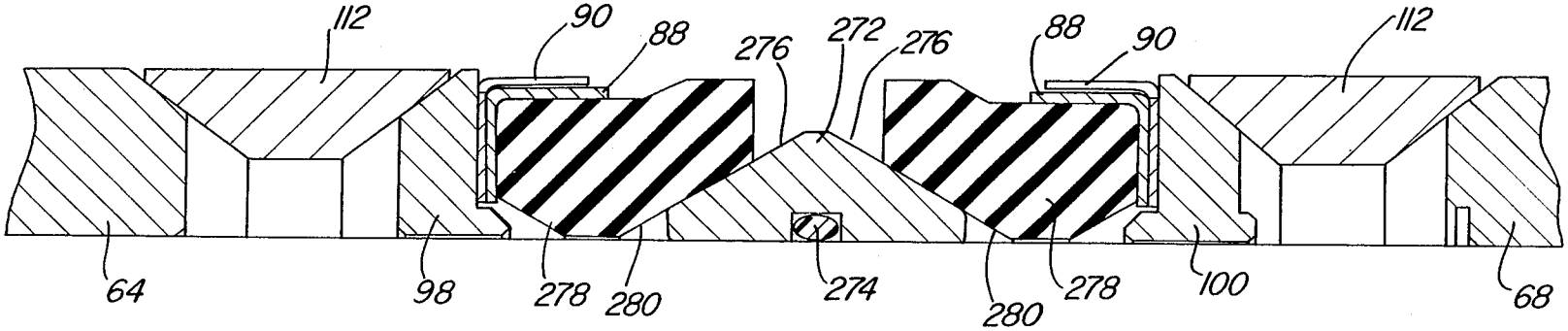
FIG. 10 is a partial cross-sectional view of a still further embodiment of the packing means of the present invention.

FIG. 10 shows a still further embodiment of the packing measn 42. As shown therein, the spacer 272 has a substantially triangular cross-section with sloped surfaces 276. As with the previous embodiment, the slope of the surfaces 276 can be varied in order to vary the force required to set the packing elements 278. Accordingly, the slope of the inwardly disposed edge 280 must be varied so as to conform to the slopes of the spacer.

Thus, the packing means 42 of the present invention provides an effective sealing engagement between the mandrel 30 and the casing wall 12. However, because the components of the packing means are slidably mounted to the mandrel 30 these components are able to compensate for pressure variations as will be described in conjunction with operation of the invention.

Operation of the tool will cause a sequential setting of the packing means 42 and the slips 40 of the upper and lower anchoring means. Initial downward pressure will cause the piston 50, piston sleeve 52, and lock housing 56 to move downwardly relative to the mandrel 30 thereby shearing screws 66 and slightly compressing the packing means 42. Additional pressure will shear screws 70 causing the slips 40 of lower anchoring means 39 to burst and engage the casing. With the lower anchoring means 39 set, continued pressure will cause compression of the packing means 42 between the lower and upper cones. Under this compression, the rings 112 will be caused to expand as the gap between the respective cones and retainers narrows. In addition, the retainers 98 and 100 will move towards each other to compress the packing elements 78 into sealing engagement with the casing 12 as shown in FIG. 8.

Referring now to FIGS. 7 and 8, upon initial compression, the packing elements 78 expand outwardly in the vicinity of the overleafs 82 causing them to expand outwardly into engagement with the casing. However, because of the resistive force applied by the expansion fingers 94, the packing elements in the vicinity of the removed portions 86 are driven downwardly into sealing engagement with the mandrel 30. Moreover, the expansion overleafs 82 prevent the packing elements 78 from extruding axially outwardly thereby forcing the elements 78 to expand inwardly towards the spacer ring 72. Further compressive force causes the packing means 42 to move downwardly causing the packing elements 78 to track along the tapered surface of the spacer ring 72. The tapered configuration of the spacer ring 72 eventually causes the radially enlarged portion of the packing elements 78 to expand outwardly into sealing engagement with the casing wall. Upon full compression and engagement of the packing means 42, the screw 62 shears allowing the slips 40 of upper anchoring means 38 to engage the casing thereby fully setting the tool for further operations.

With the packer assembly 16 set, weight or rotation of string 14 causes pin 24 to shear and the mill 22 commences cutting a window in the well casing 12 off the slanted face of the whipstock as shown in FIG. 3. In doing this, hose 26 is severed but compression of the packing assembly is maintained by the lock housing 56 and the lock nut 58. Furthermore, the teeth of the slips 40 are appropriately inclined to prevent movement of the packing assembly 16.

Alternatively, the whipstock 20 and packer assembly 16 can be independently run and set within the well bore with any subsequent operations being conducted on secondary runs of the drill string. In this manner, the dual trips of first setting the packer and thereafter running the whipstock is eliminated although any subsequent operations would require an additional trip. However, as in the preferred embodiment, the packing assembly 16 would still be capable of packing-off large gaps while compensating for variations in well pressures.

Thus, the present invention provides a simple yet effective apparatus for bridging and sealing large gaps between the tool and the casing or well bore within which it is run. Moreover, the spacer rings are able to compensate for variations in well pressure by moving accordingly to deform the packing elements as necessary. Thus, as pressure below the tool increases, the spacer ring will more upwardly to further compress the upper packing element. Similarly, if uphole pressure is increased, the spacer ring can move downwardly to further compress the lower packing element. This is a result of the O-ring seal 74 which prevents pressure leakage past the spacer ring. Although due to the deformation of the packing elements 78 some pressure leakage will occur along the mandrel 30, this flow is prevented past the spacer ring. Thus, the leakage will cause the spacer ring to move accordingly thereby preventing additional leakage and a possible blowout of the packing assembly. In addition, by combining a metal spacer ring with the resilient packing elements the sealing engagement is enhanced along the inner mandrel.

The foregoing detailed description has been given for clearness of understanding only and no unnessary limitations should be understood therefrom as some modifications will be obvious to those skilled in the art without departing from the scope and spirit of the appended claims.

We claim:

1. A packing assembly for sealing between an inner mandrel and a well casing, said assembly having expandable slip-type anchoring means mounted to the mandrel, a plurality of sleeves slidably mounted coaxially on the mandrel and means for setting the anchoring means, the improvement comprising:

packing means to sealingly engage the well casing and the inner mandrel, said packing means including a pair of resiliently deformable annular packing elements mounted on the inner mandrel and an annular spacer ring mounted on the inner mandrel between said packing elements, said spacer ring extending partially beneath said packing elements and including means for sealingly engaging the inner mandrel, said spacer ring having axially opposed sloped surfaces adapted to guide said packing elements toward the well casing, and means for compressing said packing means into sealing engagement with the well casing while preventing extrusion of said packing elements, said compressing means mounted on the inner mandrel axially above and axially below said packing means;

said spacer ring being axially movable in response to pressure variations to variably deform said packing elements when said packing elements are in sealing engagement with the well casing thereby enhancing said sealing arrangement of said packing elements with the well casing and the inner mandrel.

2. The packing assembly as defined in claim 1 wherein said means for compressing and preventing extrusion are disposed axially above and axially below said packing means, said means including annular expansion overleaf means, annular retainer means, and expansion ring means.

3. The packing assembly as defined in claim 2 wherein said expansion overleaf means comprises a plurality of expansion overleaf rings wherein at least two of said overleaf rings are disposed axially above said packing means and at least two of said overleaf rings are disposed axially below said packing means.

4. The packing assembly as defined in claim 3 wherein said overleaf rings have a substantially L-shaped cross section, an axially aligned portion of said rings overlying a portion of said packing elements and being expandable radially outwardly upon compression of said packing elements, said overleaf rings preventing axial extrusion of said packing elements.

5. The packing assembly as defined in claim 4 wherein said axially aligned portion of said overleaf rings comprises a plurality of expansion fingers, said at least two overleaf rings adjacently mounted on the inner mandrel such that said expansion fingers of one of said overleaf rings transverses the gap between said expansion fingers of said adjacent overleaf ring to prevent extrusion of said packing elements.

6. The packing assembly as defined in claim 5 wherein said annular retainer means includes retainers mounted on the inner mandrel, at least one retainer mounted axially above and axially below said packing means, said at least two overleaf rings being retained between said at least one retainer and said packing means, said retainer means cooperating with said overleaf rings to prevent extrusion of said packing elements.

7. The packing assembly as defined in claim 6 wherein said expansion ring means includes a first expansion ring positioned axially above said upper retainer and a second expansion ring positioned axially below said lower retainer, said expansion rings being radially expandable into engagement with the well casing to further prevent extrusion of said packing elements.

8. The packing assembly as defined in claim 5 wherein said packing elements include first and second radial portions, said first portion being radially larger than said second portion, said expansion fingers of said overleaf rings overlie said radially reduced second portion of said packing elements.

9. The packing assembly as defined in claim 1 wherein said means for sealingly engaging the inner mandrel of said spacer ring comprises an O-ring disposed within an annular groove formed in the inner surface of said spacer ring.

10. The packing assembly as defined in claim 1 wherein said spacer ring has a substantially cross-sectionally frusto-conical radially outer portion and annular flange members which extend beneath said packing elements along said mandrel, said axially opposed sloped surfaces formed on said frusto-conical portion of said spacer ring, said frusto-conical portion and said flange members enhancing the sealing engagement between said packing means and the well casing and inner mandrel.

11. The packing assembly as defined in claim 1 wherein said spacer ring has a substantially triangular cross-section with axially opposed sloped surfaces, said sloped surfaces of said spacer ring extending partially beneath said packing elements whereby varying the slope of said surfaces varies the force needed to set said packing means.

12. The packing assembly as defined in claim 11 wherein said spacer ring includes a radial flange formed at the radial outer portion of said spacer ring.

13. A packing assembly for sealing between an inner mandrel and a well casing, said assembly having expandable slip-type anchoring means mounted to the mandrel, a plurality of sleeves slidably mounted coaxially on the mandrel and means for setting the anchoring means, the improvement comprising:

packing means to sealingly engage the well casing and the inner mandrel, said packing means including a pair of resiliently deformable annular packing elements mounted on the inner mandrel and a non-deformable annular spacer ring mounted on the inner mandrel intermediate said packing elements, said spacer ring having axial outer portions extending beneath said packing elements and axially opposed sloped surfaces adapted to guide said packing elements toward the well casing during compression of said packing means, said spacer ring including means for sealingly engaging the inner mandrel;

means for compressing said packing means into sealing engagement with the well casing while preventing extrusion of said packing elements, said compressing means mounted on the inner mandrel axially above and axially below said packing means to compress said packing elements toward said spacer ring into engagement with the well casing;

said spacer ring being axially movable in response to pressure variations affecting said packing means to variably deform said packing elements when said packing elements are in sealing engagement with the well casing thereby enhancing said sealing engagement of said packing elements with the well casing and the inner mandrel in response to pressure variations.

14. The packing assembly as defined in claim 13 wherein said means for compressing and preventing extrusion are disposed axially above and axially below said packing means, said packing means including annular expansion overleaf means having expansion fingers positioned to prevent axial extrusion of said packing elements during compression, annular retainer means, and expansion ring means adapted to engage the well casing and prevent extrusion of said packing elements.

15. The packing assembly as defined in claim 14 wherein said packing elements include first and second radial portions, said first portion being radially larger than said second portion, said expansion fingers of said expansion overleaf means overlying said second radial portion of said packing elements.

16. The packing assembly as defined in claim 13 wherein said means for sealingly engaging the inner mandrel of said spacer ring comprises an O-ring disposed within an annular groove formed in the inner surface of said spacer ring.

17. The packing assembly as defined in claim 16 wherein said spacer ring has a substantially cross-sectionally frusto-conical radially outer portion and annular flange members which extend beneath said packing elements along said mandrel, said frust-conical portion having axially opposed sloped surfaces.

18. The packing assembly as defined in claim 16 wherein said spacer ring has a substantially triangular cross-section with axially opposed sloped surfaces.

19. An apparatus for setting a whipstock and for changing the direction of drilling through a casing wall in a single trip of the drill string, said apparatus comprising:

a whipstock;

a drill string;

a mill connected on said drill string;

means releasably connecting said mill to the upper portion of said whipstock;

a packing assembly for setting said apparatus;

a fluid passage extending through said drill string, said mill, and said whipstock to said packing assembly;

said packing assembly including:

expandable slip-type anchoring means with means for setting said anchoring means;

packing means adapted to sealingly engage the casing wall including at least two resiliently deformable packing elements and a spacer ring for variably deforming said packing elements in response to fluid pressure in said well casing, said spacer ring disposed between said packing elements and extending partially beneath said packing elements; and means for compressing said packing means into sealing engagement with the casing wall while preventing extrusion of said packing elements;

said packing assembly being responsive to fluid pressure supplied through said fluid passage means.

20. The apparatus as defined in claim 19 wherein said spacer ring includes means for sealingly engaging an inner mandrel and axially opposed sloped surfaces adapted to guide said packing elements toward the well casing during compression.

21. An apparatus for setting a whipstock and for changing the direction of drilling through a casing wall in a single trip of the drill string, said apparatus comprising:

a whipstock;

a drill string;

a mill connected on said dril string;

means releasably connecting said mill to the upper portion of said whipstock;

a packing assembly for setting said apparatus;

a fluid passage extending through said drill string, said mill, and said whipstock to said packing assembly;

said packing assembly including:

expandable slip-type anchoring means with means for setting said anchoring means;

packing means adapted to sealingly engage the casing wall including at least two resiliently deformable packing elements and a non-deformable spacer ring for variably deforming said packing elements in response to fluid pressure in said well casing, said spacer ring disposed between said packing elements such that a portion thereof extends beneath said packing elements, said spacer ring including axially opposed sloped surfaces adapted to guide said packing elements toward the well casing; and means for compressing said packing means into sealing engagement with the casing wall while preventing extrusion of said packing elements.

* * * * *